US006935544B2

(12) United States Patent
Torrents I Comas

(10) Patent No.: US 6,935,544 B2
(45) Date of Patent: Aug. 30, 2005

(54) MANUAL TILE CUTTER

(75) Inventor: Josep Torrents I Comas, Rubi (ES)

(73) Assignee: Germans Boada, S.A. (ES)

( * ) Notice: Subject to any disclaimer, the term of this patent is extended or adjusted under 35 U.S.C. 154(b) by 59 days.

(21) Appl. No.: 10/333,311

(22) PCT Filed: Feb. 19, 2002

(86) PCT No.: PCT/ES02/00075

§ 371 (c)(1),
(2), (4) Date: Jun. 5, 2003

(87) PCT Pub. No.: WO02/092308

PCT Pub. Date: Nov. 21, 2002

(65) Prior Publication Data

US 2004/0025662 A1 Feb. 12, 2004

(30) Foreign Application Priority Data

May 14, 2001 (ES) ..... 200101095

(51) Int. Cl.[7] ..... B28D 1/24
(52) U.S. Cl. ..... 225/96.5; 83/886; 125/23.02
(58) Field of Search ..... D8/51, 52, 98; 125/35, 23.01, 23.02; 83/886, 887; 225/96, 96.5; D15/127

(56) References Cited

U.S. PATENT DOCUMENTS 2,163,868 A * 6/1939 Christie ..... 83/468.93
D331,762 S * 12/1992 Matt ..... D15/127
5,480,081 A * 1/1996 Wilson et al. ..... 225/96.5
5,505,359 A * 4/1996 Joecker, Jr. ..... 225/96.5
5,626,124 A * 5/1997 Chen ..... 125/23.02
6,012,441 A * 1/2000 Liu ..... 125/35
6,053,159 A * 4/2000 Liu ..... 125/23.02
D424,585 S * 5/2000 Torrents Comas ..... D15/127
6,148,810 A * 11/2000 Hepworth ..... 125/23.01
D434,782 S * 12/2000 Comas ..... D15/127

FOREIGN PATENT DOCUMENTS

| | | |
|---|---|---|
| ES | 2101611 | 7/1997 |
| ES | 2142736 | 4/2000 |

* cited by examiner

*Primary Examiner*—Stephen Choi
(74) *Attorney, Agent, or Firm*—Ostrolenk, Faber, Gerb & Soffen, LLP

(57) ABSTRACT

The invention relates to a manual tile cutter comprising a support base (1), the short sides of which are provided with diverging walls (2) that extend upwards. Both ends of the longitudinal guides (3) for the cutting head are fixed inside said walls. The longer sides of the support base (1) are provided with flat flanges (8) which are mounted so that they can be pulled down during use, around horizontal rotation axes, into a horizontal position which is coplanar with the base (1), or pushed up into a vertical transport position which is perpendicular to the base (1).

6 Claims, 2 Drawing Sheets

MANUAL TILE CUTTER

AIM OF THE INVENTION

The present invention refers to a manual tile cutter, being of the type that has a support base with an upper surface for the stable positioning of tiles to be cut, longitudinal guides for the moveable folding head assembly with a grip handle, a cutting wheel support for the marking of the cutting line on the tile, and some stops to cause the breaking of the piece of tile along the cutting line marked by the wheel.

BACKGROUND TO THE INVENTION

At the present time the manual tile cutters which have a base that forms the support surface for the tile to be cut, a head which has a handle for its movement, assembled in such a way that the head can move longitudinally along the fixed base guides, are widely known in the market.

The above stated head has a wheel carrier on to which a handle is fitted with a wheel or cutting disc by means of which the cutting line of the tile is marked, some stops with the form of protruding legs to cause the breaking of the piece of tile along the cutting line by means of pressure.

One of the problems of these types of cutters is the need to provide a surface with enough width in order to carry out the stable support of the tile during the marking and cutting of same, hence the base of the machine has a significant width, considerably increasing the weight and making the transportation more difficult.

In some cases, in order to increase to a greater degree the support surface of the tile to be cut, the base has some fold away arms that are fitted onto a vertical shaft, allowing it to be unfolded towards the outside or to have them parallel to the sides of the base.

In whichever case, these types of cutters must have a base of significant width with the disadvantages that this brings with it.

Usually the assembly of the guides to the base is carried out by means of end supports, independent of the base and which are fixed onto it by means of screw on elements or something similar. The use of these end supports for the assembly of the guides on which the head is moved poses different problems such as an increase in the number of pieces that makes up the cutter and the carrying out of differing processes in order to guarantee the guides are correctly in parallel, necessary to obtain the smooth movement of the head during the scratching or marking of the tile by the corresponding wheel.

DESCRIPTION OF THE INVENTION

The tile cutter object of the present invention, being of the above-mentioned type, which means, that it has a support base and guides for the fitting of a moveable head fitted with an element for the marking or scratching of the tile to be cut, and some feet to bring about the breakage along this marked cutting line, has some constructive features aimed at simplifying its manufacture, to reduce the number of component parts with the resulting reduction in cost and weight, and to considerably reduce the space taken up by same in its closed or transport position.

In accordance with the invention, the support base has sides that as they rise are inclined outwards, onto which the longitudinal guides of the cutter are fixed at each end; the base on its larger sides has flat wings fitted so that they fold away on horizontal turning shafts that allow said wings to be in a horizontal position when in use, in the same plane as the base, or in a vertical position for transport and being perpendicular to the base.

The above-mentioned sides that are inclined outwards are formed as part of the body itself of the support base, making up a single piece. This peculiarity allows the elimination of the problems posed by the use of end supports, independent of the base, in order to carry out the assembly of the cutter guides onto the base.

The outward inclination of the walls forming the smaller walls of the base, allows on one hand, a significant simplification in the moulds used for the manufacture of the base in the event of it being cast and, on the other hand, reduces the space necessary to allow the cutting head to be in a position that does not interfere with the folding up of the side wings into their transport position, as will be explained later.

In accordance with the invention, the stated outward inclined walls have a width equal to that of the cutter base, as the obtaining of a surface area of sufficient size to achieve the stable support of the tile to be cut on the base will be determined by the sum of the areas of said base and the side wings when in their unfolded position.

In accordance with the invention, said outwardly inclined walls have a slight curvature in an ascending direction towards the inner side.

The side wings in general have a rectangular shape and some openings have been cut out of them in order to reduce the weight of same, in such a way that they do not mean an increase in weight proportional to the surface area supplied by same.

Said side wings have some protrusions or stops for the support of the tile in the cutting position on their upper surface and next to one of their ends. Said protrusions or stops are lined up with others fitted to the base of the cutter and usually used on these types of machines.

In accordance with the invention, the length of the side wings is shorter than that of the base, one of the ends of said side wings being fitted at a distance greater than that of the length of the cutting head from the inclined wall of the same side.

This distancing allows the head to be in its transport position on one of the ends of the guides, out of the way of the side wings in their vertical folded up or transport position, considerably reducing the volume occupied by the cutter in said transport position.

DESCRIPTION OF THE FIGURES

In order to complement the description that has been made and for the purpose of making the characteristics of the invention easier to understand, attached to this present document is a set of drawings in which, by way of being illustrative but not limiting, the following has been represented.

Figure 4:
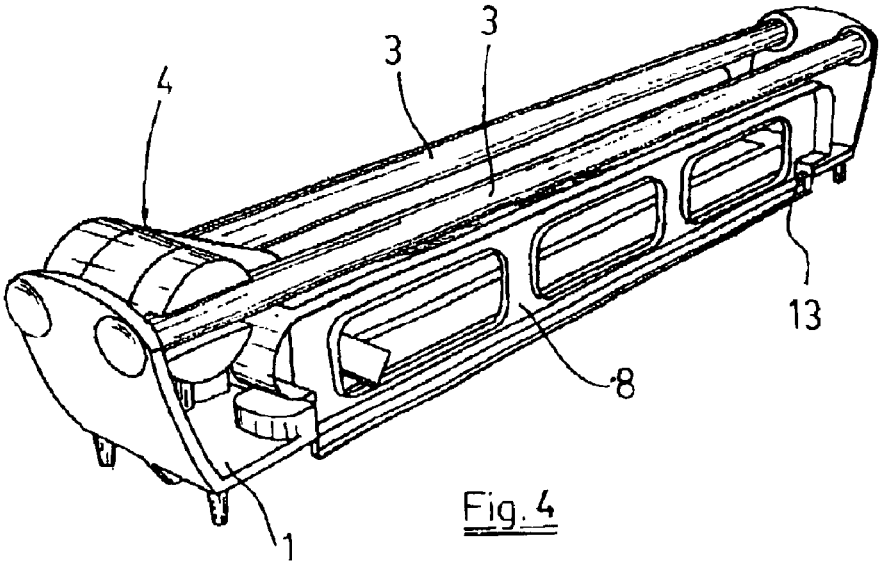
Figure 5:
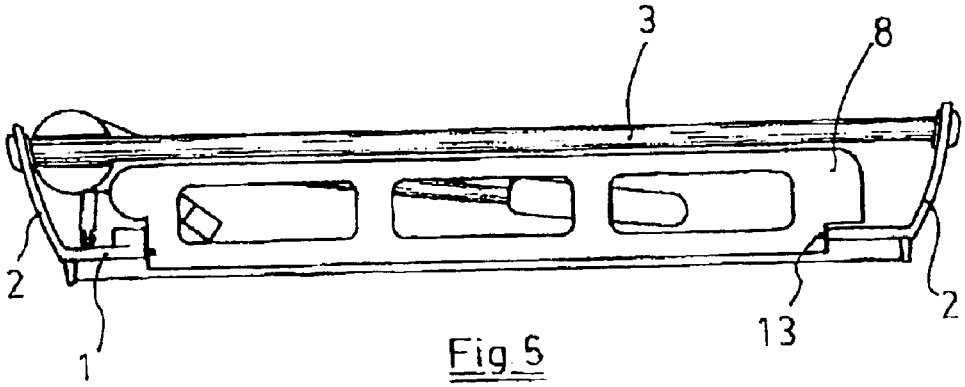

The FIGS. 4 and 5 respectively show both views in perspective and elevation of the manual tile cutter in its transport position.

CARRYING OUT OF THE INVENTION

As can be observed in the referenced figures, this manual tile cutter has a single piece base (1) that joins with both smaller lateral outwardly inclined walls (2) orientated towards the top and with a slight curvature in an upward direction.

The ends of some longitudinal guides (3) are fixed to onto the outwardly inclined walls (2) onto which a head (4) with a grip handle (5), a roller cutting wheel (6) is assembled to allow for longitudinal movement, and so by the means of which the marking of the cutting line can be made onto the tile, in addition there are some fold down stops (7) in order to bring about, by pressure, the breakage of the previously marked tile.

As can be seen in the referenced figures the outwardly inclined walls (2) have a width equal to that of the base (1).

Figure 1:
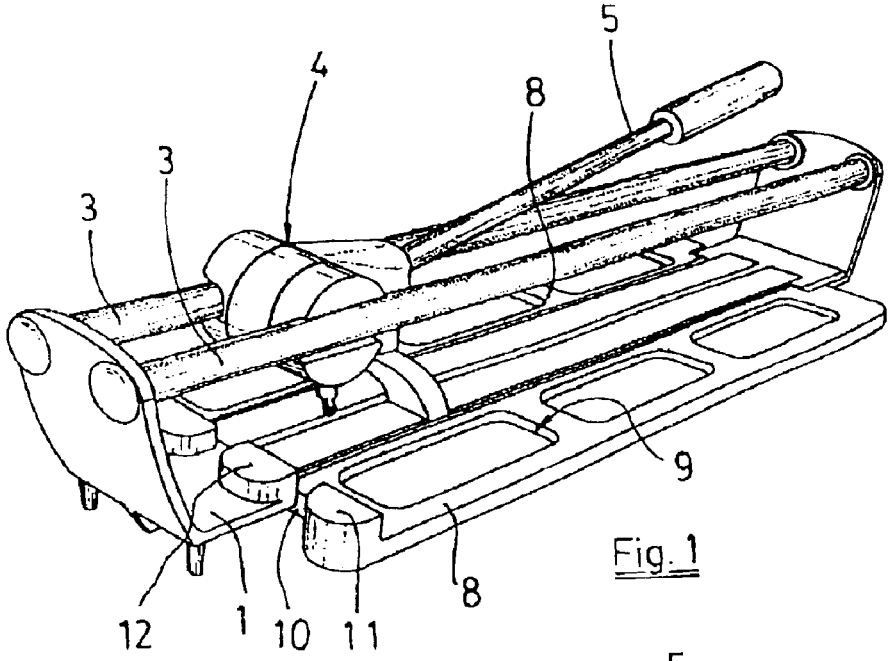
FIGS. 1, 2 and 3 respectively show views in perspective, elevation and profile of a manual tile cutter in its position of use, which means, with the wings folded down.
Figure 2:
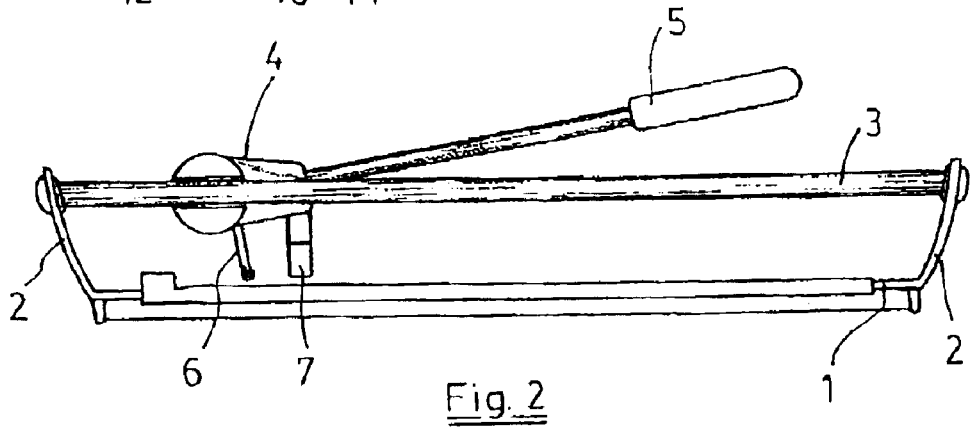
Figure 3:
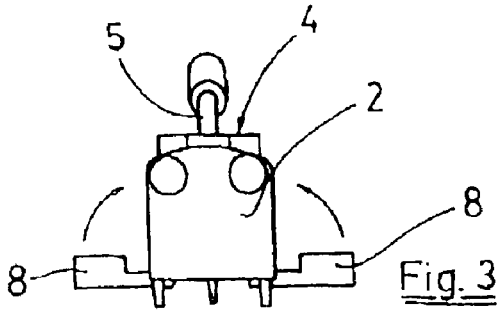

Some side wings (8) are rotatably fitted on a horizontal shaft, onto the longer sides of said base (1), which wings may be deployed to its use position, as shown in FIGS. 1, 2 and 3, and are in the same plane as the base, or equally in a vertical position, perpendicular to the base (1) for transport, as shown in FIGS. 4 and 5.

Said side wings (8) have internal slots cut out (9) in order to lessen their weight.

As can be seen in FIGS. 4 and 5, the side wings (8) have some protrusions (11) on their upper surface and joined to their ends (10) which will be used as stops for the tile once placed onto the base (1) in the cutting position. These protrusions or stops (11) can make a complement for the protrusions (12) fitted to the base (1).

The side wings (8) have a shorter length than that of the base (1), in such a way that the end (10) of same are kept away from the outwardly inclined wall (2), corresponding to the same side, at a distance greater than that of the cutting head (4), so that it can move towards one of the ends of the guides (3) without it becoming an obstacle when the side wings (8) are folded up into their transport position.

In said transport position, the handle (5) can be folded down towards the bottom into a position between the guides (3); the outwardly inclined walls (2) and the side wings (8) marking out a rectangular prism shaped cavity that corresponds to the volume necessary to carry out the positioning and transport of the cutter.

The example of the make up shown in the figures, the turning shafts for the side wings (8) to the base (1) are represented by some pivots or stubs (13) that start from some cut out made on the sides of the base and into which the opposing ends of the wings (8) are introduced.

Once having sufficiently described the nature of the invention, likewise an example of its preferred make up, it is placed on record to whom it may concern that the materials, shape, size and layout of the elements described can be modified, whenever they do not mean an alteration of the essential characteristics of the invention that is claimed below.

What is claimed is:

1. A manual tile cutter, comprising a support base (1) with an upper surface for stable positioning of tiles to be cut, longitudinal guides (3) for a moveable folding head assembly (4) with a grip handle (5), a cutting wheel support (6) for marking a cutting line on the tile, and stops (7) to cause breaking of the tile along the cutting line marked by the wheel; characterised in that the support base (1) has side walls (2) that as they rise are inclined outwards, onto which the longitudinal guides are fixed at each end; the base (1) on its larger sides has flat wings (8) fitted so as to be pivotable on horizontal turning shafts that allow said wings (8) to pivot downwardly into a horizontal position when in use, in the same plane as the base (1), or upwardly into a vertical position for transport and being perpendicular to the base (1).

2. Cutter in accordance with the previous claim, is characterised in that the outwardly inclined walls (2) are fixed to the base itself(1), making up a single piece body with it, and having an equal width to the stated base (1) of the cutter.

3. Cutter in accordance with claim 1 is characterised in that said outwardly inclined walls (2) have a slight curvature in an ascending direction towards the inner side.

4. Cutter in accordance with claim 1 is characterised in that the side wings (8) have a generally rectangular shape and some slots in them (9) in order to reduce the weight.

5. Cutter in accordance with claim 1 is characterised in that the side wings (8) have some protrusions or stops (11) for the stable support of the tile in the cutting position on their upper surface and next to one of their ends.

6. Cutter in accordance with claim 1, is characterised in that the side wings (8) have a length shorter than that of the base (1), one of the ends (10) of said side wings (8) being fitted at a distance greater than that of the length of the cutting head (4) from the inclined wall (8) of the same side.

* * * * *